US012593949B2

(12) United States Patent
Hug

(10) Patent No.: US 12,593,949 B2
(45) Date of Patent: Apr. 7, 2026

(54) CLEANING DEVICE AND USE

(71) Applicant: ReBerni Limited, Kwai Chung (HK)

(72) Inventor: Bernhard Hug, Winterthur (CH)

(73) Assignee: ReBerni Limited, Kwai Chung (HK)

( * ) Notice: Subject to any disclaimer, the term of this patent is extended or adjusted under 35 U.S.C. 154(b) by 348 days.

(21) Appl. No.: 18/031,744

(22) PCT Filed: Oct. 13, 2021

(86) PCT No.: PCT/EP2021/078244
§ 371 (c)(1),
(2) Date: Apr. 13, 2023

(87) PCT Pub. No.: WO2022/079069
PCT Pub. Date: Apr. 21, 2022

(65) Prior Publication Data

US 2023/0380646 A1 Nov. 30, 2023

(30) Foreign Application Priority Data

Oct. 13, 2020 (EP) ..... 20201554

(51) Int. Cl.
*A47L 9/18* (2006.01)
*A47L 7/00* (2006.01)

(52) U.S. Cl.
CPC ..... *A47L 9/181* (2013.01); *A47L 7/0061* (2013.01)

(58) Field of Classification Search
CPC ..... A47L 9/185; A47L 7/0061; A47L 9/20; A47L 9/18; A47L 9/181
(Continued)

(56) References Cited

U.S. PATENT DOCUMENTS 979,211 A 12/1910 Serrell
5,199,963 A 4/1993 Scarp
(Continued)

FOREIGN PATENT DOCUMENTS

DE 102017208968 A1 * 11/2018 ..... A47L 11/4016
JP S5811485 U 1/1983
(Continued)

OTHER PUBLICATIONS

International Search Report and Written Opinion dated Jan. 26, 2022 issued in corresponding application PCT/EP2021/078244.
(Continued)

*Primary Examiner* — Katina N. Henson
(74) *Attorney, Agent, or Firm* — Bachman & LaPointe, P.C.

(57) ABSTRACT

A cleaning device (I) for suctioning a volumetric flow of particle-laden suction-air from an environment, includes: an air-receiving opening (2) having a first line cross section (21) for suctioning the volumetric flow of particle-laden suction-air from the environment in an active operating state; a liquid-receiving unit (4) having an immersion tube (3) for receiving a liquid, wherein the immersion tube (3) is connected at a first end (7) to the air-receiving opening (2) for conducting suction air and is designed such that at a second end (8) it is immersed into the receivable liquid such that, in an active operating state, the volumetric flow of particle-laden suction-air flows through the receivable liquid to trap the particles; and a vacuum generator (6) for generating the volumetric flow of suction-air in the active operating state.

18 Claims, 6 Drawing Sheets

(58) Field of Classification Search
USPC ..... 15/300.1
See application file for complete search history.

(56) References Cited

U.S. PATENT DOCUMENTS

| | | | | |
|---|---|---|---|---|
| 2007/0067943 | A1* | 3/2007 | Makarov | A47L 9/122 15/339 |
| 2019/0151788 | A1* | 5/2019 | Zhang | A47L 9/181 |

FOREIGN PATENT DOCUMENTS

| | | | | | |
|---|---|---|---|---|---|
| JP | H06222190 | A | | 8/1994 | |
| JP | 2004510118 | A | | 4/2004 | |
| JP | 2005218827 | A | | 8/2005 | |
| JP | 2005319282 | A | | 11/2005 | |
| JP | 2012152664 | A | | 8/2012 | |
| JP | 2019048376 | A | | 3/2019 | |
| KR | 20120061784 | A | * | 6/2012 | A47L 9/18 |
| WO | WO-2020225040 | A1 | * | 11/2020 | G01N 15/0205 |

OTHER PUBLICATIONS

Extended European Search Report dated Feb. 25, 2021 issued in corresponding application EP20201554.1.

* cited by examiner

CLEANING DEVICE AND USE

BACKGROUND OF THE INVENTION

The present invention relates to a cleaning device for aspirating a suction air volume flow loaded with particles, aerosols, bacteria and/or viruses. Furthermore, the present invention relates to the use of the cleaning device according to the invention as an ambient air cleaning device and/or as a wet vacuum cleaner.

Cleaning devices having a liquid holding unit for aspirating and cleaning a suction air volume flow loaded with particles are generally known from the state of the art.

The known cleaning devices comprise vacuum generating means for aspirating the suction air volume flow together with the particles through an air intake opening. The suction air volume flow loaded with the particles is then transported through an immersion tube into a liquid held by a liquid holding unit. When flowing through the liquid along a forming flow path, the suction air volume flow is cleaned since the carried particles are largely trapped in the liquid and can thus be retained there.

A disadvantage in this context is a high flow velocity of the suction air volume flow since large bubbles form in the process and the passage through the liquid is fast, which is disadvantages for the retention of the particles in the liquid and thus for good cleaning effect of generic cleaning devices.

SUMMARY OF THE INVENTION

For this reason, the object of the invention is to overcome the disadvantages of a cleaning device. In particular, the object of the present invention is to provide a cleaning device which also achieves a good cleaning effect with a widely varying suction air volume flow.

The object of the present invention is attained by a cleaning device as disclosed herein, specifically by the fact that a second conduit cross section of the immersion tube for guiding the suction air volume flow is larger than the first conduit cross section of the air intake opening at least at the second end.

The invention intends to provide a cleaning device for aspirating a suction air volume flow loaded with particles, aerosols, bacteria and/or viruses from an environment, the cleaning device comprising an air intake opening having a first conduit cross section and serving to aspirate the suction air volume flow loaded with the particles from the environment, a liquid holding unit comprising an immersion tube and serving to hold a liquid, in particular water, the immersion tube being connected to the air intake opening at a first end in a suction-air-conducting manner and being configured in such a manner that it is partially immersed in the held liquid, in particular the water, in such a manner at a second end that the suction air volume flow loaded with the particles flows through the held liquid when the cleaning device is in an active mode so that the particles are retained, and vacuum generating means for generating the suction air volume flow in active mode. According to the invention, a second conduit cross section of the immersion tube for guiding the suction air volume flow is larger than the first conduit cross section of the air intake opening at least at the second end.

In other words, the cleaning device according to the invention comprises an air intake opening which has a first conduit cross section and which is configured to aspirate an air/particle mixture from an environment; the term particles as used in the present invention refers to dust, preferably ultrafine dust, fine dust, and/or coarse dust, aerosol particles, bacteria and/or viruses. The aspirated suction air volume flow loaded with the particles is formed by vacuum generating means comprised by the cleaning device.

Furthermore, the cleaning device according to the invention comprises a liquid holding unit which has an immersion tube according to the invention and which is configured to hold a liquid, in particular a cleaning liquid.

The immersion tube is connected to the suction opening at one end in a suction-air-conducting manner, in particular directly or via a supply conduit, and ends in the held liquid at the other end in order to ensure that the suction air volume flow loaded with the particles flows through the liquid along a flow path so that the particles are separated from the suction air volume flow and trapped in the liquid in a first filter stage, which is formed by the liquid.

Now, according to the invention, the immersion tube has a second conduit cross section at the end immersed in the liquid, said second conduit cross section being larger than the first conduit cross section of the air intake opening.

Advantageously, the widening of the cross section from the air intake opening, which is disposed at the inlet, to the immersion tube of the first filter stage, which is disposed at the outlet, leads to a deceleration of the flow velocity of the suction air volume flow generated when the cleaning devices is in an active mode, which is why smaller air bubbles form during the passage through the liquid and the dwell time of the suction air volume flow during the passage through the held liquid can be increased because of the reduced flow velocity. Thus, the cleaning effect is advantageously improved since more particles can be retained in the liquid by comparison.

Advantageously, the internal widening of the conduit cross section as per the invention does not affect the suction air volume flow at the air intake opening, which is required for aspirating the particles and/or the particle/air mixture, which is why a sufficiently high suction power for aspirating particles can be achieved there in relation to the flow velocity.

According to the present invention, water or tap water is preferably used as a cleaning liquid for the liquid holding unit for forming the first cleaning stage so as to enable a faster exchange and a simple disposal when the liquid has accumulated a large amount of dirt.

Furthermore, it is noted that a standby mode of the cleaning device refers to a passive operating state of the cleaning device, during which the liquid holding unit receives a liquid, in particular water, in such a manner that the end of the immersion tube is at least partially immersed in the received liquid.

In standby mode, the vacuum generating means do not generate a suction air volume flow, which is why no turbulences, eddies and/or air bubbles are formed, in particular along the flow path, in the held liquid.

In an active mode of the cleaning device, on the other hand, the suction air volume flow generated by the vacuum generating means aspirates a particle/air mixture. Furthermore, in active mode, the suction air volume flow loaded with the particles flows through the immersion tube into the held liquid, which is why turbulences, eddies and/or swirls are formed there, the liquid being traversed along a flow path and particles carried by the suction air volume flow being retained and fixed.

Advantageous embodiments of the invention are indicated in the dependent claims, the following description, the figures and the description of the figures. Any and all combinations of at least two features disclosed in the description, the claims and or the figures fall within the scope of the invention.

In a preferred embodiment of the cleaning device according to the present invention, a ratio between the second conduit cross section of the immersion tube and the first conduit cross section of the air intake opening is at least 2, preferably at least 3, further preferably at least 3.5.

In other words, the ratio of the diameter or the cross section of the immersion tube at the second end to the diameter or the cross section of the air intake opening is to be greater than or equal to 2, preferably greater than or equal to 3, further preferably greater than or equal to 3.5, so that the flow velocity of the suction air volume flow is influenced. Advantageously, the sudden, continuous and/or stepwise increase in the conduit cross section from the air intake opening to the second end of the immersion tube leads to a decrease in the mean flow velocity of the suction air volume flow, a ratio selected in this manner enabling a particularly efficient cleaning (high cleaning effect) of the suction air volume flow loaded with the particles as it is passing through the liquid along the flow path.

Moreover, such a ratio ensures not only that a high cleaning effect can be achieved during the passage through the liquid but also that a sufficient suction power for aspirating the particle/air mixture through the air intake opening is made possible.

According to another example, the immersion tube comprises at least one arched and/or angular deflecting portion and a sinking portion, which is in particular oriented along a vertical axis, the deflecting portion being configured in such a manner that the suction air volume flow loaded with the particles is deflected from an inflow direction and is swirled in active mode so that the flow velocity can be influenced for the first time.

Furthermore, it is preferably envisaged in this context that the immersion tube is composed of two or more parts. A two-part or multi-part design of the immersion tube is particularly advantageous if this allows a flap and/or a lid to be removed from the immersion tube in order to remove the particles collected in the coarse filter in a passive operating state of the cleaning device and thus facilitate cleaning of the coarse filter.

Furthermore, the sinking portion is preferably configured in such a manner that the suction air volume flow deflected in the deflecting portion, swirled and decelerated in active mode of the cleaning device is additionally decelerated relative to a mean inflow velocity by a sudden, step-wise or continuous widening of the conduit cross section.

Moreover, the sinking portion is dimensioned in such a manner regarding its length (longitudinal dimension) that the eddies formed largely abate and settle prior to entry into the liquid. Advantageously, this leads to a deceleration of the suction air volume flow and a homogenous distribution of the particles, which takes effect in the entire conduit cross section of the immersion tube According to an embodiment, the deflecting portion is configured to the effect that, in active mode, the suction air volume flow loaded with the particles is deflected by a deflection angle β of more than 60°, preferably more than 70°, particularly preferably more than 80°, most preferably essentially 90°, relative to the inflow direction defined by the air intake opening.

Thus, the deflection of the suction air volume flow enables an initial reduction of the flow velocity of the suction air volume flow since at least part of the suction air volume flow collides with the inner wall of the immersion tube in the deflecting portion.

Moreover, it is noted that a deflection angle β of about 90° means in particular a range which is preferably between 88° and 92°.

According to another embodiment, the immersion tube is disposed within the liquid holding unit in such a manner that the sinking portion extends in the vertical direction. Advantageously, a sinking portion extending along the vertical axis has the effect that the suction air volume flow loaded with the particles flows perpendicular to a liquid surface formed by the liquid in the passive operating state and thus also flows into the liquid in a direction perpendicular, i.e., at a right angle, to said liquid surface.

In this context, it is noted that the liquid does not form an even liquid surface in active mode since the entering suction air volume flow causes eddies, swirls and/or superimposing waves in the held liquid of the liquid holding unit. Still, the flow path of the suction air volume flow during passage through the liquid can be positively influenced regarding the cleaning effect by the vertical introduction of the suction air volume flow into the held liquid.

In other words, the immersion tube is preferably disposed in the liquid holding unit in such a manner that the longitudinal dimension of the immersion tube is oriented perpendicular or at a right angle to a liquid surface formed in standby mode at least in the area of the second end, i.e. in such a manner that it extends along a vertical axis. Advantageously, this has the effect that the weight force acting on the particles because of their own weight is oriented in a direction longitudinal to the flow direction of the suction air volume flow. Furthermore, the suction air volume flow thus has to undergo a deflection of 180° relative to its inflow direction in order to flow back out of the liquid. Advantageously, this has a positive impact on the cleaning effect.

According to another example of the present invention, the cleaning device comprises a second filter stage, which is formed by a lattice-like coarse filter for retaining large particles. The coarse filter is preferably formed and/or disposed in an area of the immersion tube which is fully immersed in the liquid. Preferably, the coarse filter is formed by a plurality of rod-shaped pins, which are spaced apart from each other and extend in a direction longitudinal to the axis of extension of the immersion tube, in particular longitudinal to the length of the sinking portion, that is, in particular in the vertical direction. The pins form gap-like openings for the suction air volume flow in the wall surface of the immersion tube, said openings retaining large particles and fixing and collecting them within the immersion tube since they do not fit through the gap-like openings. In this context, large particles mean particle sizes comprising a longitudinal, transverse and/or width dimension greater than 2 mm.

Aside from retaining the large particles in the immersion tube, the coarse filter additionally improves the cleaning effect for smaller particles during passage through the liquid since larger particles swimming freely in the liquid have a negative impact on the cleaning effect for small particles, i.e., in particular particles having a longitudinal, transverse and/or width dimension less than 2 mm.

Particularly preferably, the first filter stage and the second filter stage can be removed from the cleaning device or a housing of the cleaning device for cleaning purposes, for example. This enables a practical operation and maintenance of the cleaning device. Particularly preferably, handle elements facilitating removal can be provided.

These parts or components as well as other parts and modules of the cleaning device can be removable or can be removable from a housing. Preferably, the removability can be ensured by detachable fastening means. Particularly preferably, the detachable fastening means can be pairs of permanent magnets which are suitably aligned with each other in the installed state, one permanent magnet being installed or disposed in a fixed place in the cleaning device and a second permanent magnet being disposed on the removable part or the removable module in such a manner that a magnetic holding force securing the removable parts or modules is generated between the permanent magnets in the installed state, the holding force being set in such a manner via the permanent magnets and their position and alignment, in particular their distance, in the installed state that an operator can overcome said holding force manually and preferably without tools, particularly preferably by exerting force on handle elements, when removing the part or the module. As an alternative to pairs of permanent magnets, pairs of a permanent magnet and a magnetic or magnetizable, preferably soft-magnetic, material can be formed. This further facilitates handling and maintenance of the cleaning device.

In this context, it is further intended for the immersion tube to preferably have an end face at the second end which is connected to a bottom element of the liquid holding unit in such a manner that the suction air volume flow can flow only through the openings formed by the coarse filter in active mode.

Thus, the immersion tube extends in particular as far as to the bottom element of the liquid holding unit, the end face of the immersion tube being preferably connected to the bottom element. Consequently, the suction air volume flow loaded with the particles can flow out of the immersion tube only through the lateral openings of the coarse filter formed in the wall surface of the immersion tube. Alternatively, the end of the immersion tube can be closed by an in particular disk-shaped end element to ensure that the entire suction air volume flow flows out of the immersion tube through the openings of the coarse filter.

In an embodiment, the cleaning device comprises a droplet separator which is disposed between the liquid holding unit and the vacuum generating means in a suction-air-conducting manner for retaining liquid droplets and other particles absorbed by the suction air volume flow.

Advantageously, the droplet separator forms a third filter stage of the cleaning device since, after the passage through the liquid for retaining particles (first filter stage) and the passage through the coarse filter for retaining large particles (second filter stage), the droplet separator also filters particles out of the suction air volume flow (third filter stage). Aside from the filtering out of particles, however, liquid droplets previously absorbed by the suction air volume flow during passage through the liquid are also separated from the suction air volume flow in the droplet separator.

Advantageously, the droplet separator is disposed, relative to the liquid holding unit, in an area which makes it possible for the liquid droplets absorbed from the suction air volume flow to be transported back into the liquid holding unit. Advantageously, this prevents a quick loss of liquid when the cleaning device is in operation, which is why longer operating times of the cleaning device are possible. Furthermore, this can additionally improve the cleaning effect since, besides the absorption of liquid droplets, particles which could not be trapped in the liquid during the passage through the liquid holding unit can also be removed from the suction air volume flow.

In an embodiment, the droplet separator comprises a flowward area formed by a plurality of spaced-apart profiled fins, in particular sheet-metal-like fins, a flow channel having at least two deflection areas for the suction air volume flow being formed between each two adjacent fins and/or the flowward area being oriented at a fixation angle between 20° to 70°, preferably 30° to 60°, particularly preferably 40° to 50°, most preferably essentially 45°, relative to a horizontal plane, in particular relative to a liquid surface of the liquid held by the liquid holding unit.

In an embodiment, the flowward area is advantageously formed by a surface against which the suction air volume flow flows and from which a plurality of slot-like passages for the suction air volume flow extend. In active mode, the suction air volume flow flows onto the flowward area, which is oriented at an angle to a horizontal plane, which is why the suction air volume flow splits up into a plurality of partial flows, each of which flows along a passage formed between the fins (flow channel). The passages comprise deflection areas formed by an arched curvature of the fins and thus forming vacuum areas. Advantageously, the deflection of the partial flows has the effect that the liquid droplets and other particles are absorbed by the partial flows because of the inertia acting on them.

Furthermore, the droplet separator is advantageously oriented at an angle to a horizontal plane, which has the effect that the absorbed liquid droplets flow back into the liquid holding unit because of the weight force. Furthermore, a quick discharge of the liquid droplets has the effect that the liquid droplets are not absorbed again. Advantageously, this leads to a reduction in the moisture absorbed by the suction air volume flow and/or the number of contained liquid droplets which are discharged back into the environment through an air discharge opening at the outlet of the cleaning device.

In other words, the droplet separator and the flow channels formed are oriented and/or configured in such a manner that the liquid droplets can be transported away from the flow channels because of the weight force acting on them after they have been separated from the suction air volume flow. In this context, it is preferred for the liquid droplets to be subsequently transported back into the liquid holding unit in order to avoid a loss of liquid in active mode of the cleaning device.

In an embodiment, the droplet separator is static and/or immobile and in particular does not comprise any rotating elements. Advantageously, this leads to an efficient cleaning device in terms of energy consumption. Furthermore, this allows providing a cleaning device which is characterized by low noise when in operation and which persons present therefore generally perceive as quiet and therefore non-disturbing.

In an embodiment, the cleaning device furthermore comprises a filter unit for filtering out fine particles (residual particles) carried by the suction air volume flow, the filter unit being in particular disposed in a suction-air-conducting manner between the droplet separator and the vacuum generating means in a channel passage in the suction air path. Advantageously, this enables a further improvement of the cleaning device according to the invention in order to improve the filter effect of the cleaning device on fine dust. Furthermore, this makes it advantageously possible for the cleaning device to be extended by a fourth cleaning stage in order to additionally improve the cleaning effect of the cleaning device at hand.

In an embodiment, the filter unit additionally comprises a seat unit configured to accommodate an exchangeable fabric filter. During the passage through the fabric filter, the suction air volume flow can additionally be freed from fine dust and/or ultra-fine dust since the latter accumulates in the fabric filter as it is flowing through the fabric filter as a function of a selectable porosity. The use of fabric filters with different porosities thus also enables an application-specific optimization.

According to another example, UV- and/or UVC-light generation means are provided, which are comprised by the cleaning device. Advantageously, the light generation means are disposed in the cleaning device to the effect that the suction air path taken by the suction air volume flow generated in active mode in the cleaning device is at least partially illuminated in such a manner with light beams of a certain wavelength range, preferably between 100 nm to 450 nm, further preferably between 100 nm to 280 nm, in particular along an interior passage, that the suction air volume flow generated in active mode is fully illuminated in order to kill carried viruses and germs. Preferably, the passage within which the illumination takes place is a closed unit so that in particular an escape of the (harmful) UVC rays to the environment at the operating site of the cleaning device is avoided.

Moreover, according to an embodiment of the present invention, the cleaning device according to the invention is used as an air cleaning device for cleaning ambient air and/or as a wet vacuum cleaner. According to another embodiment, the cleaning device according to the invention is used as an air drying device. In this case, the cleaning device can advantageously not be operated or put into operation with a liquid, in particular water, in the liquid holding unit at first. Instead, an initially empty liquid holding unit can be used as a collecting reservoir for moisture or liquid removed from the air.

Furthermore, the vacuum generating means can advantageously have a low-pressure air outlet at the outlet and/or a high-pressure air inlet at the inlet. This has a positive impact on efficiency and noise generation.

Advantageously, the low-pressure air outlet can have an expansion space disposed in the housing of the cleaning device.

Preferably, the expansion space is disposed between a first portion of the air outlet and an exhaust gap. Particularly preferably, the exhaust gap is a preferably closed circumferential gap. Particularly advantageously, the expansion space and/or the exhaust gap can have a round or oval or elliptical basic contour.

Also, the exhaust gap can particularly preferably be radially adjacent to the outer side of the expansion space. Individually and in combination, the configurations mentioned have a positive influence on the flow properties and thus the efficiency and the noise generation of the vacuum generating means.

In another advantageous embodiment, the expansion space can be formed under a handle of the cleaning device, a component or a module, preferably a one-piece, in particular monolithic, component, forming the handle or at least part of the handle, for example, as one of two handle shells, and at least partially limiting the expansion space. Particularly preferably, the component or the module also at least partially limits the exhaust gap. Particularly preferably, the component or the module is an exhaust air guiding feature with a handle molded thereon or a handle shell molded thereon.

BRIEF DESCRIPTION OF THE DRAWINGS

Other advantages, features and details of the invention are apparent from the following description of preferred embodiment examples and from the drawings.

DETAILED DESCRIPTION

Figure 1:
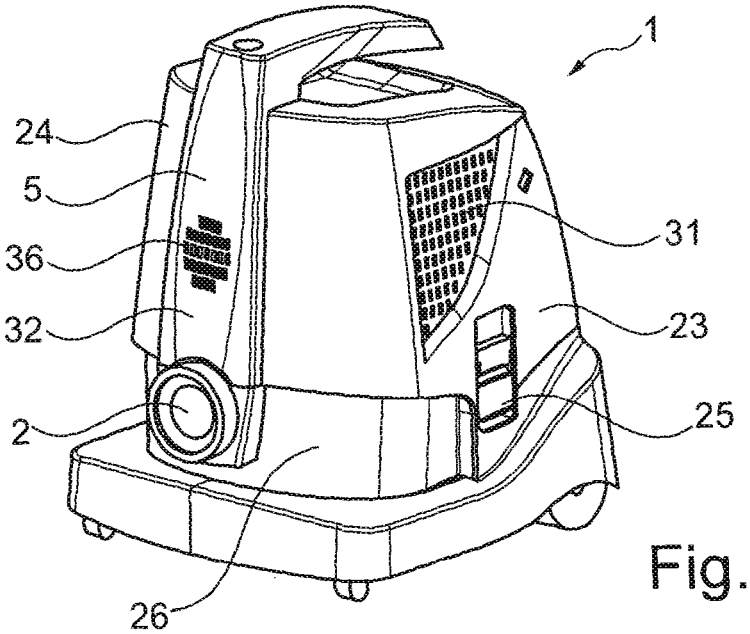
FIG. 1: is a perspective view of a preferred embodiment of a cleaning device according to the invention.

FIG. 1 shows a perspective view of a first preferred embodiment of a cleaning device 1 according to the invention for aspirating a suction air volume flow loaded with particles from an environment.

Illustrated cleaning device 1 comprises an air intake opening 2, which is configured to aspirate the suction air volume flow from an environment in an active mode of cleaning device 1, air intake opening 2 preferably being connectable to a suction hose (not shown) in a suction-air-conducting manner so as to form in particular a wet vacuum cleaner.

Alternatively, cleaning device 1 can be used without a suction hose so as to aspirate ambient air directly through air intake opening 2 and thus form an ambient air cleaning device for filtering out aspirated particles.

Cleaning device 1 comprises an upper housing element 5 and is disposed on four rollers. Closure means 5, which connect upper housing element 5 to a lower housing element 26 of cleaning device 1, are disposed on two opposite side surfaces 23 and 24 of upper housing element 5.

Air intake opening 2, through which the suction air volume flow, i.e., a particle/air mixture aspirated from the environment, is aspirated in active mode of cleaning device 1, is disposed in lower housing element 26 on front 32 of cleaning device 1. Upper housing element 5 comprises a plurality of ventilation openings 36 (perforations) for a cooling circuit of cleaning device 1.

Furthermore, air discharge openings 31, through which the suction air volume flow is returned to the environment after a multi-stage cleaning, are disposed on side surfaces 23 and 24. The exact path of the suction air volume flow loaded with the particles and the different cleaning stages of cleaning device 1 according to the invention are described with reference to FIG. 3 and FIG. 4.

Figure 2:
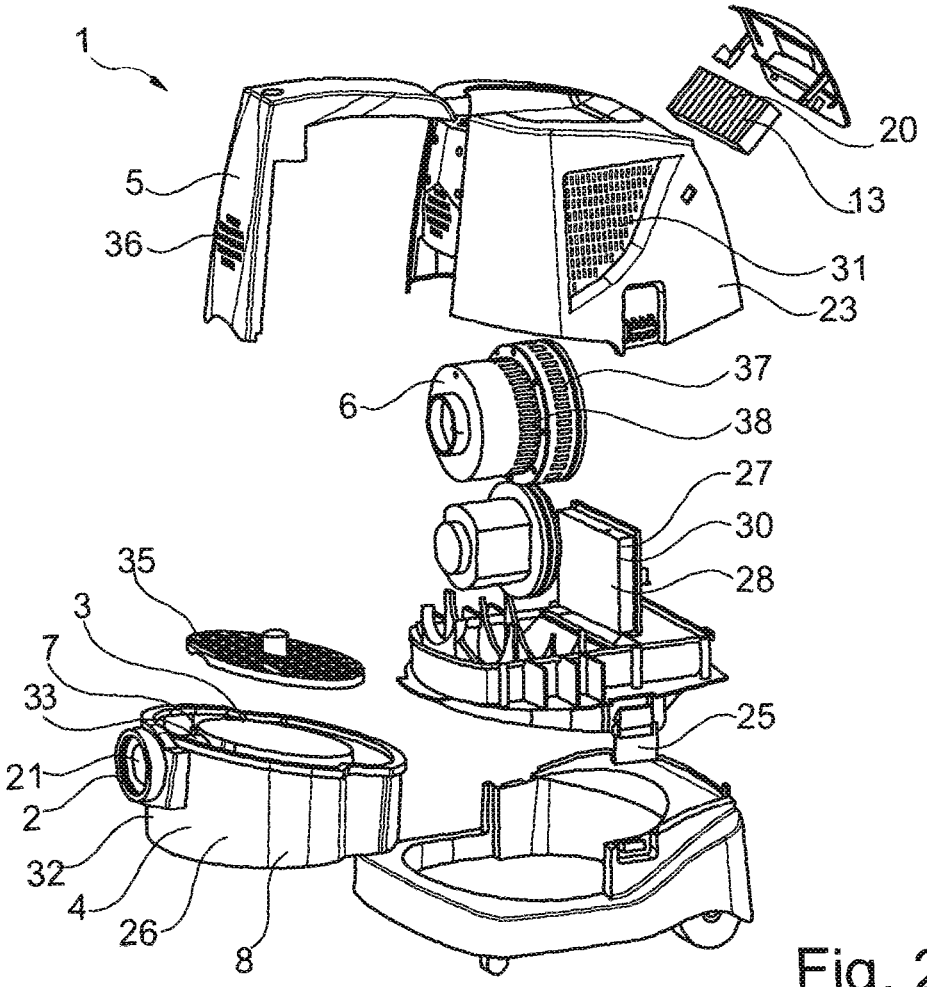
FIG. 2: is an exploded illustration of the cleaning device known from FIG. 1.

FIG. 2 shows an exploded illustration of the cleaning device 1 known from FIG. 1. As the illustration shows, lower housing element 26 of cleaning device 1 is formed by a liquid holding unit 4, which has a vat for holding liquid and an immersion tube 3. Air intake opening 2, which is formed on front 32 and serves to aspirate the suction air volume flow loaded with the particles from the environment in active mode of cleaning device 1, comprises a first conduit cross section 21 and is connected to a first end 7 of immersion tube 3 of liquid holding unit 4 in a suction-air-conducting manner via a supply conduit 33. Immersion tube 3 protrudes into the held liquid at a second end 8 with the result that the suction air volume flow loaded with the particles flows through the held liquid along a flow path so that the particles are retained and trapped in the liquid in active mode of cleaning device 1. Immersion tube 3 comprises a lid element 35 for forming a cleaning opening so that particles retained in the immersion tube 3 can be removed manually (by operating personnel).

Upper housing element 5 presses lid element 35 onto immersion tube 3 in an air-tight manner by means of spring means (not shown), closure means 25, which are disposed on either side, locking lid element 35 in a pressurized manner in active mode of cleaning device 1. Advantageously, the air-tight arrangement of lid element 35 on immersion tube 3 prevents the formation of bypasses of the suction air volume flow, which is why the entire suction air volume flow flows through the liquid so that particles are retained in active mode.

Furthermore, cleaning device 1 illustrated comprises vacuum generating means 6, which are formed by an electric motor in the case at hand, the electric motor generating the suction air volume flow for aspirating an air/particle mixture by rotating in active mode of cleaning device 1. The electric motor is cooled by a cooling circuit using ambient air, the cooling circuit aspirating the air through openings 36 in upper housing element 5.

The electric motor can preferably be a brushless electric motor. Vacuum generating means 6 can have an air outlet 39, which guides the generated suction air volume flow out of cleaning device 1. In the example of the embodiment of FIGS. 1 to 4, air outlet 39 is a duct which ends in an opening, preferably a lattice opening or a multi-slot opening of upper housing element 5. An alternative configuration in which a low-pressure air outlet is formed is explained with reference to FIGS. 7 to 10.

Furthermore, vacuum generating means 6 comprise a cooling circuit discharge opening 38, which is formed at the circumference and serves to discharge the aspirated air of the cooling circuit, and a suction air volume flow discharge opening 37, which is formed at the circumference and serves to discharge the suction air volume flow.

Advantageously, upper housing element 5 comprises no more than two air discharge openings 31, which are each formed by a perforation in side surfaces 23 and 24 of cleaning device 1, so that the air can be discharged from the cooling circuit and the cleaned suction air volume flow can be discharged back into the environment.

Furthermore, cleaning device 1 comprises a droplet separator 13, through which the suction air volume flow flows, in which process liquid droplets and other particles can be separated from the suction air volume flow because of provided flow channels 20.

Moreover, the exploded illustration shows that another filter stage of cleaning device 1 is formed by a filter unit 27, which has a seat unit 28 for a fabric filter 30. Seat unit 28 places fabric filter 30 in a suction air path of the suction air volume flow in such a manner that the latter flows through fabric filter 30 so that the particles are retained. Advantageously, the minimum size of the residual particles can be determined by selecting the pore density, which is why this filter stage is suitable in particular for filtering out fine dust.

Figure 3:
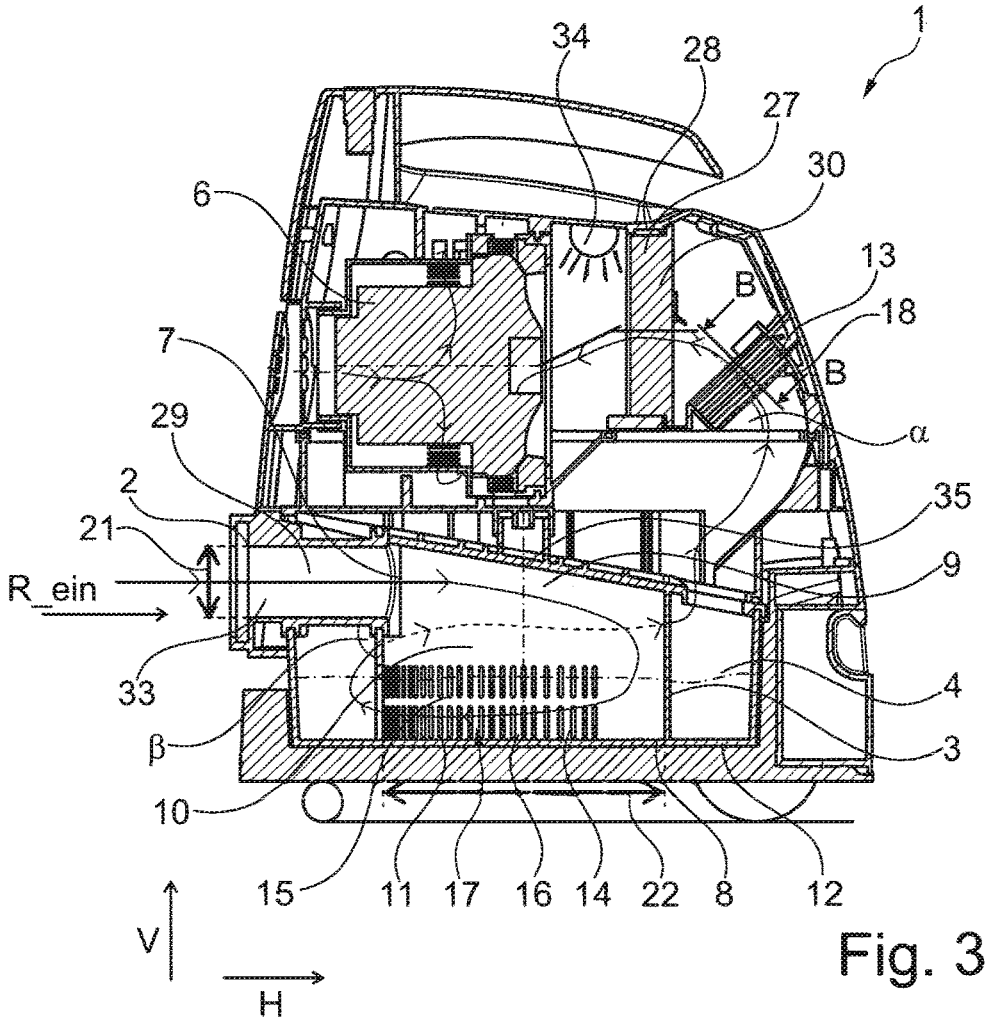
FIG. 3: is a first section view of the known cleaning device along a vertical plane.

FIG. 3 is a sectional illustration of known cleaning device 1 in a vertical plane, suction air path 29, through which the generated suction air volume flow passes in active mode of cleaning device 1, being schematically outlined by directional arrows.

As mentioned, the suction air volume flow loaded with the particles is aspirated from the environment through air intake opening 2 in active mode of cleaning device 1, air intake opening 2 having a first conduit cross section 21. Air intake opening 2 is in operative connection with a first end 7 of immersion tube 3 of liquid holding unit 4 via a hollow cylindrical supply conduit 33.

Immersion tube 3 comprises a deflecting portion 9, which is configured in such a manner that the suction air volume flow loaded with the particles is deflected in an essentially vertical outflow direction relative to a horizontal inflow direction R_ein at first end 7 in active mode. Furthermore, immersion tube 3 comprises a sinking portion 10, which extends along a vertical axis V and which is at least partially immersed in the liquid held by liquid holding unit 4.

According to the invention, immersion tube 3 has a second conduit cross section 22 at second end 8, second conduit cross section 22 being larger than first conduit cross section 21 of air intake opening 2. Advantageously, the widening of the conduit cross section from air intake opening 2 to second end 8 of immersion tube 3 leads to a decrease in the flow velocity of the suction air volume flow. Thus, the flow velocity of the suction air volume flow is reduced as the latter is flowing through the liquid, which is why the cleaning effect during the passage through the liquid is improved. Advantageously as per the invention, the lower flow velocity means that more particles from the suction air volume flow are trapped in the liquid.

Furthermore, the sectional illustration of FIG. 3 shows that the deflecting portion 9 is configured in such a manner that the conduit cross section widens from first conduit cross section 21 to second conduit cross section 22 and that an angle element having a deflection angle β of 90° is provided, which is why first conduit cross section 21, which is oriented in the vertical plane, transitions into second conduit cross section 22, which extends in a horizontal plane.

Deflection angle β, which is 90°, causes the suction air volume flow to flow against the inner wall surface of immersion tube 3, which results in a first manipulation of the flow velocity.

Furthermore, the sectional illustration shows that sinking portion 10 of immersion tube 3 has an exit area 15 at the wall, exit area 15 having a plurality of openings 14 for forming a coarse filter 17, openings 14 being formed by a plurality of rod-shaped pins 16. Pins 16 are oriented parallel to each other and extend along sinking portion 10, two immediately adjacent pins 16 forming openings 14, which are gap-shaped. Since pins 16, which extend along a vertical axis, are connected in an intermediate portion for increasing the stability of immersion tube 3, two adjacent pins 16 always form two gap-like openings 14, which have a width of about 2 mm and a length of about 20 mm and which are offset from each other relative to a vertical axis.

Advantageously, coarse filter 17 forms a second filter stage of cleaning device 1, which retains large particles not fitting through openings 14, which are 2 mm wide, from the suction air volume flow.

Moreover, lid element 35, which is disposed on immersion tube 2 against a spring force, forms a maintenance opening and/or a cleaning opening for manually removing particles retained by coarse filter 17 from immersion tube 3.

Furthermore, the sectional illustration also shows that immersion tube 3 is connected to a bottom element 12 of liquid holding unit 4 at second end 8. For this purpose, end face 11 of immersion tube 3 is in direct contact with bottom element 12 at second end 8. Thus, bottom element 12 forms a barrier for the suction air volume flow, which has the effect that the suction air volume flow flows out of immersion tube 3 through the openings formed at the wall.

After it has fully flown through the liquid, the suction air volume flow reaches droplet separator 13, which is disposed behind liquid holding unit 4 in a suction-air-conducting manner in suction air path 28 in order to separate liquid droplets absorbed by suction air volume flow during its passage through the liquid from suction air volume flow and return them into liquid holding unit 4. Advantageously, other particles besides the liquid droplets can also be separated from the suction air volume flow in the process, which is why droplet separator 13 constitutes a third cleaning stage of cleaning device 1.

Furthermore, the position of droplet separator 13 shows that it is disposed at a fixation angle $\alpha$ of 45° relative to a horizontal plane, and the lowermost edge of droplet separator 13, which extends into the drawing plane along a depth axis, is disposed above liquid holding unit 4 in order to facilitate returning the liquid into liquid holding unit 4. Thus, the recovered separated liquid droplets are returned into liquid holding unit 4 because of the weight force acting on them.

Furthermore, in active mode of cleaning device 1, the suction air volume flow finally flows through filter unit 27, which is disposed between vacuum generating means 6 and droplet separator 13 in a suction-air-conducting manner. Filter unit 27 allows fine particles carried by the suction air volume flow to be filtered out, which can be specifically influenced in an advantageous manner by selecting a pore density of fabric filter 30.

For orienting and fixing fabric filter 30, filter unit 27 comprises seat unit 28, which is in particular configured to accommodate fabric filter 30 in a clamping manner. Thus, a fourth cleaning stage of cleaning device 1 can be formed in an advantageous manner.

After flowing through fabric filter 30, the suction air volume flow flows through a passage which is preferably illuminated by UVC light rays generated by means of UVC-light generation means 34. Advantageously, the UVC light rays kill viruses and germs carried by suction air volume flow, which is how a fifth cleaning stage of cleaning device 1 can be formed.

After flowing through the illuminated passage, the suction air volume flow reaches vacuum generating means 6, which are formed by a rotating electric motor in the case at hand. Then, the cleaned suction air volume flow is discharged back into the environment through known air discharge openings 31 in side surfaces 23 and 24.

Furthermore, it is noted that the vacuum generating means 6 are disposed in an upper area of cleaning device 1. Advantageously, the lower area, which comes into contact with the liquid, can thus be spatially separated from the upper area of cleaning device 1, which is sensitive to moisture because of the installed electronics.

Figure 4:
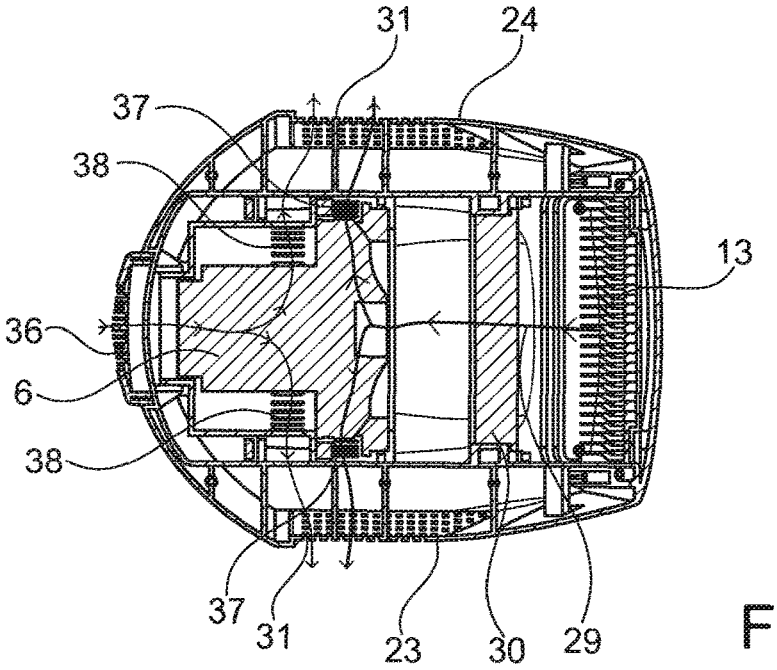
FIG. 4: is a second section view of the known cleaning device along a horizontal plane.

FIG. 4 shows a second section view of known cleaning device 1 along a horizontal plane.

The illustration shows the path of the suction air volume flow along outlined suction air path 29 at the outlet, the suction air volume flow being discharged to the environment first through suction air volume flow discharge opening 37 and then through air discharge opening 31, which is formed in the housing by the perforation, in opposite side surfaces 23 and 24.

Furthermore, a cooling circuit of vacuum generating means 6 is schematically illustrated, ambient air for cooling vacuum generating means 6 being aspirated through ventilation opening 36 and discharged back into the environment through cooling circuit discharge openings 38, which are disposed at the circumference of vacuum generating means 6, and air discharge opening 31.

Figure 5:
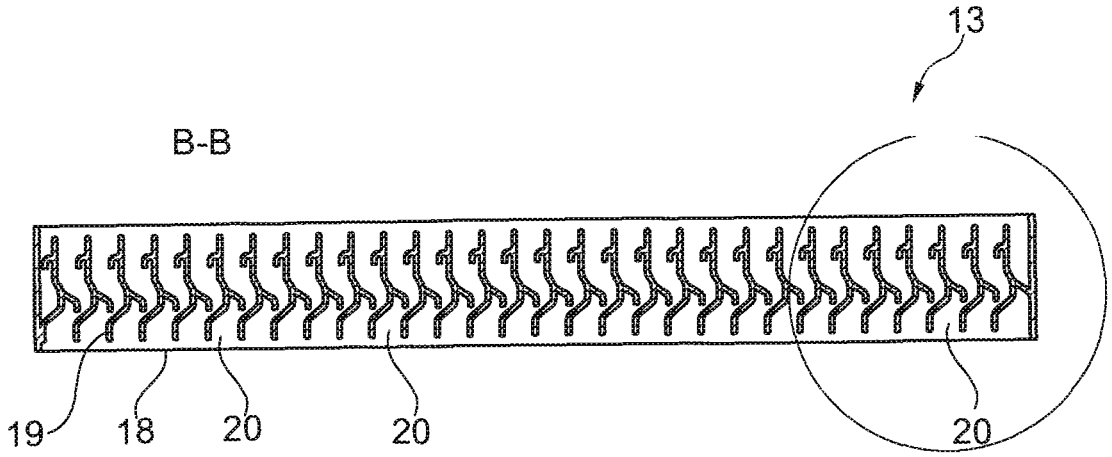
FIG. 5: is a third section view of the liquid absorber in perspective B illustrated in FIG. 3.

FIG. 5 is a section view of droplet separator 13 from a perspective B indicated in FIG. 3.

First of all, the section view shows flowward area 18, which extends in a plane and which forms a plurality of spaced-apart profiled fins 19, a flow channel 20 for a partial flow of the suction air volume flow, which strikes flowward area 18 frontally, being formed between each two immediately adjacent fins 19.

Sheet-metal-like fins 19 have arched profiles in the predefined flow direction along flow channels 20, the profiles forcing the partial flows to change direction and generating a vacuum area. The changes in direction have the effect that the carried liquid droplets experience a centrifugal force because of the inertia due to their mass, the centrifugal force causing the liquid and the carried particles (residual particles) to be absorbed.

Figure 6:
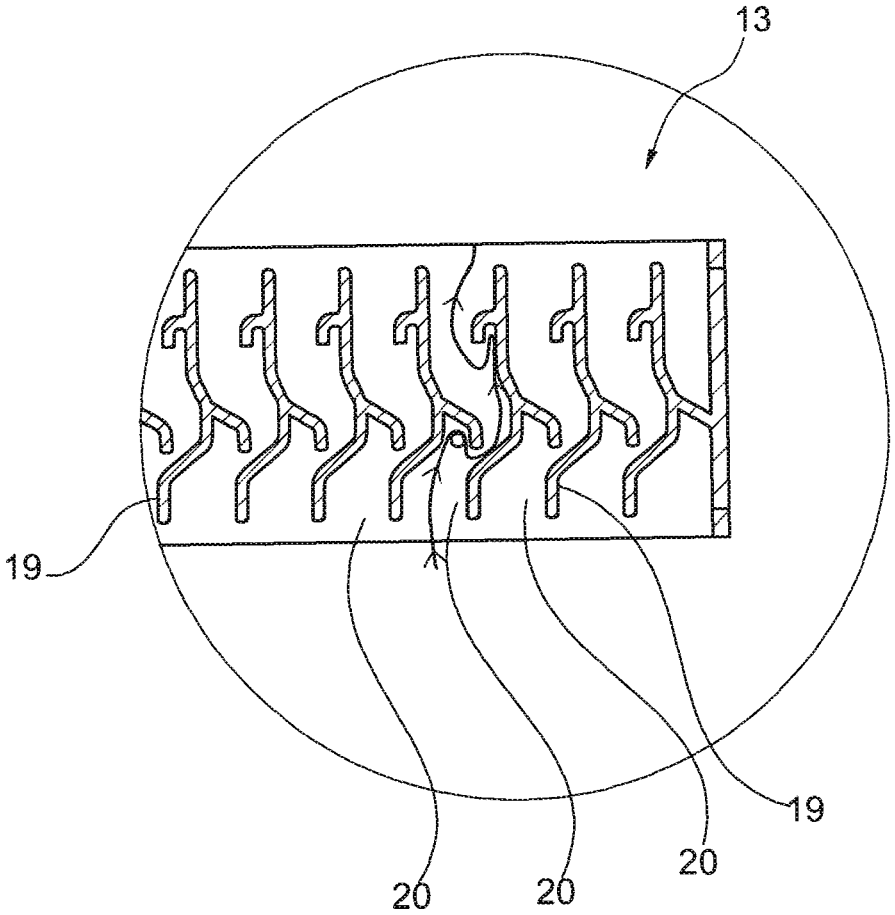
FIG. 6: shows a partial section of FIG. 5 on an enlarged scale.

In FIG. 6, the area encircled in FIG. 5 is illustrated on a larger scale. Furthermore, the path of a partial flow of the suction air volume flow during the passage through flow channels 20 of droplet separator 13 is schematically outlined.

The schematic illustration shows that the arched profile forms deflection areas for the partial flows, which is why the partial flows are forced to change direction at least twice as they are flowing through flow channels 20, the changes in direction causing the carried liquid droplets and residual particles to be separated.

With reference to FIG. 3, it is noted that flowward area 18 of liquid absorber 13 is selected small and/or smaller compared to second conduit cross section 22 of immersion tube 3. Thus, the flow velocity of the suction air volume flow can be advantageously increased again when the suction air volume flow strikes liquid absorber 13 in order to thus also increase the centrifugal force acting on the liquid droplets and/or the residual particles. Thus, a large portion of the carried liquid droplets can advantageously be separated from the suction air volume flow and be returned into the liquid holding unit.

Figure 7:
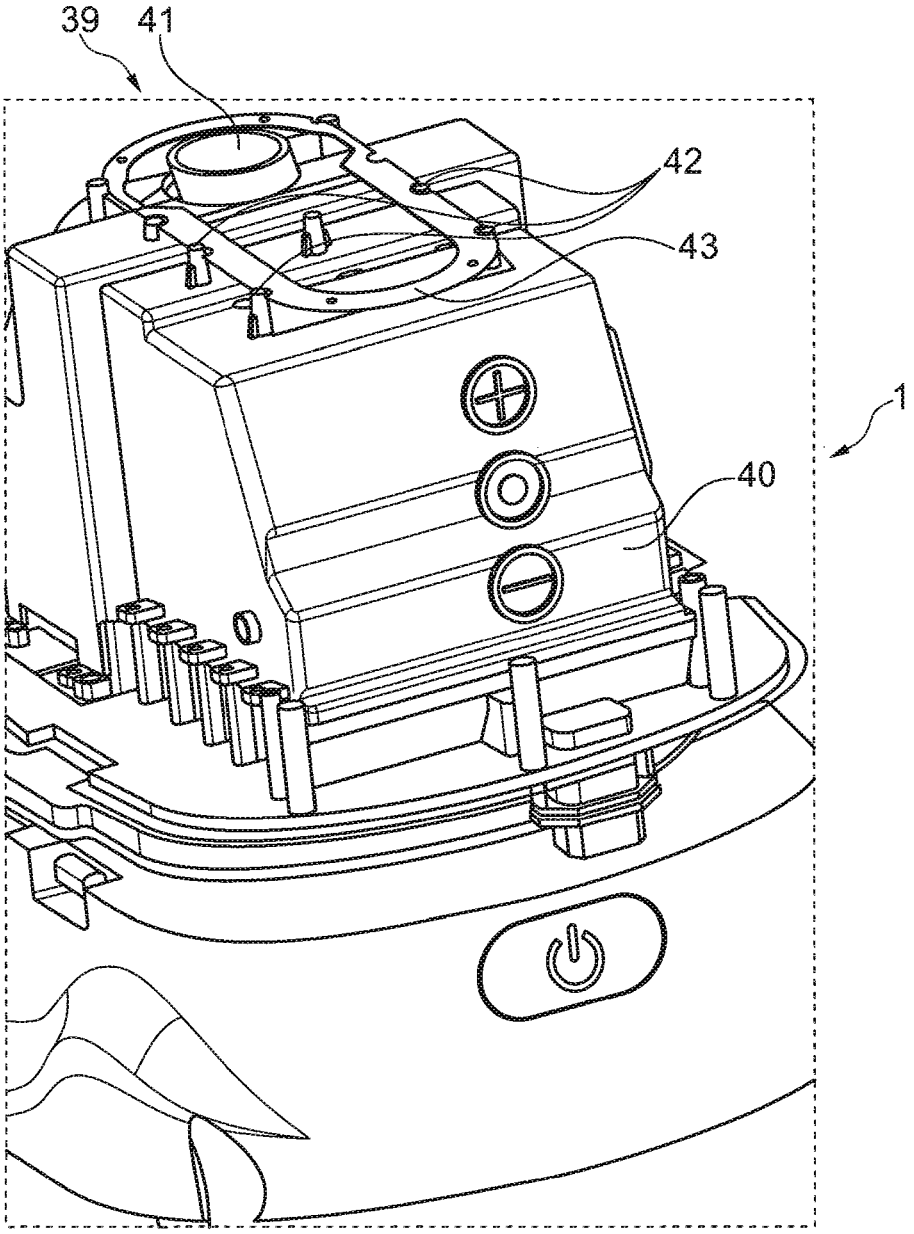
FIG. 7: is a perspective view of part of an alternative embodiment of the cleaning device according to the invention.

FIG. 7 is a perspective view of an alternative embodiment of cleaning device 1 according to the invention with a low-pressure air outlet. FIG. 7 shows cleaning device 1 without an upper housing element 5, which has been removed and is therefore not illustrated. An inner housing element 40 is visible, which can serve to house or cover vacuum generating means 6, for example. Preferably, inner housing element 40 provides sound insulation.

FIG. 7 further shows a first portion 41 of an air outlet 39 at the outlet of vacuum generating means 6. Multiple mounts 42 for mounting upper housing element 5 on inner housing element 40 are formed around first portion 41 of air outlet 39. Preferably, a damper element 43 can be provided, which can come into contact with the upper housing element for noise suppression. Damper element 43 can preferably be plugged onto mounts 42 and/or can be placed in contact with mounts 42.

Figure 8:
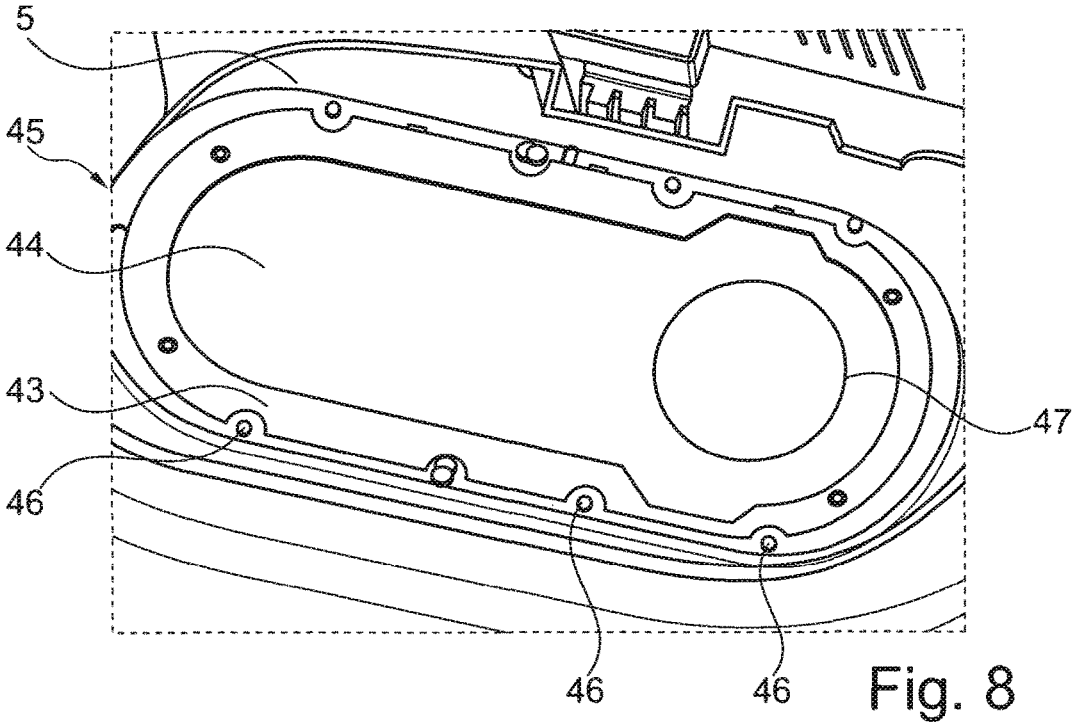
FIG. 8: shows a section of an upper housing element of the cleaning device according to the invention of FIG. 7.

FIG. 8 shows a section of an upper housing element 5 together with a damper element 43. The damper element is located at a bottom 44 of a preferably vat-shaped expansion space 45. Upper housing element 5 has a plurality of recesses 46. Some of recesses 46 can serve to pass fastening means, such as screws, through them in order to connect upper housing element 5 to inner housing element 40, for example. One recess 47 has a larger diameter and extends in the bottom of expansion space 45. First portion 41 of air outlet 39 can be passed through recess 47. Thus, the suction air volume flow of vacuum generating means 6 enters expansion space 45, which has a larger volume than first portion 41, via first portion 41 at the outlet. This leads to a relaxation and a sedation of the flow of the suction air volume flow, which enables a more energy-efficient operation of vacuum generating means 6 and additionally serves the purpose of noise suppression.

Figure 9:
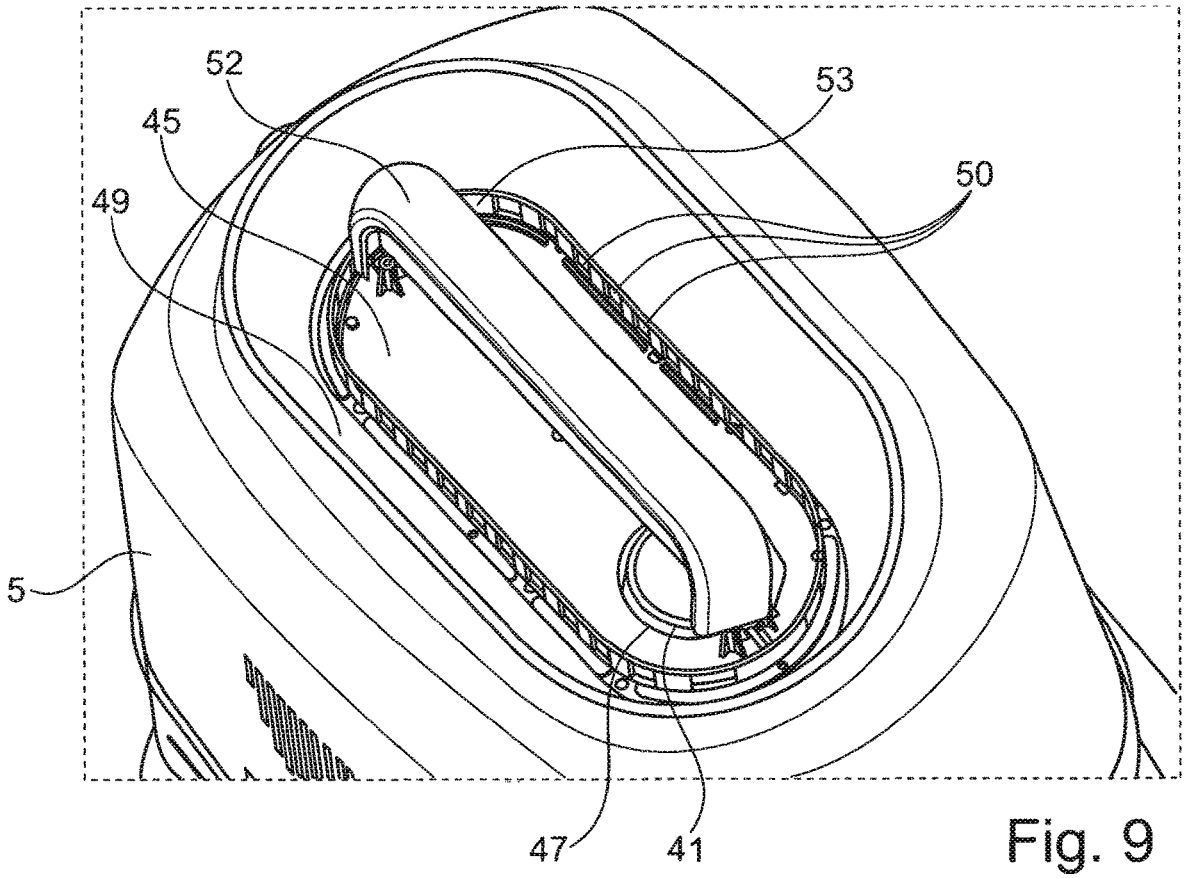
FIG. 9: shows the upper housing element of FIG. 8 without an upper exhaust air guiding feature.
Figure 10:
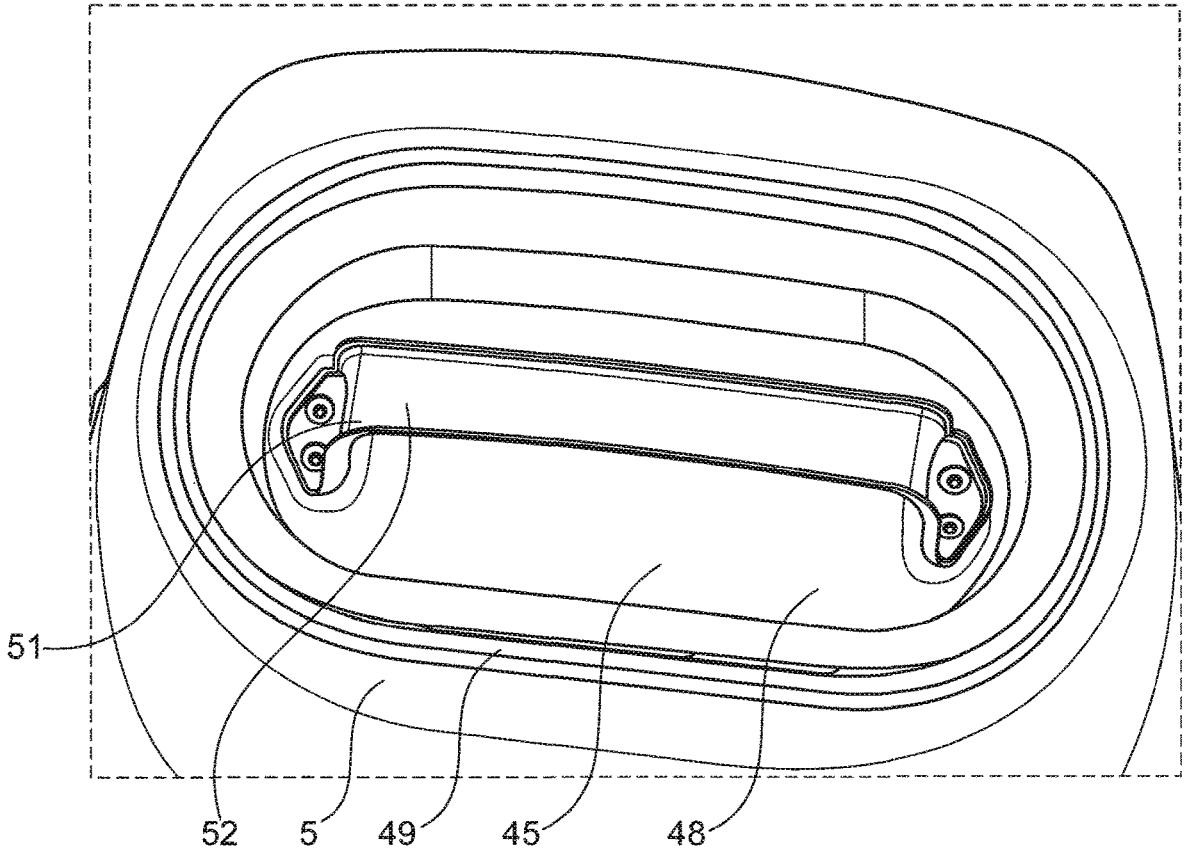
FIG. 10: shows the upper housing element of FIG. 8 with an upper exhaust air guiding feature.

FIG. 9 and FIG. 10 show upper housing element 5 with (FIG. 10) and without (FIG. 9) an upper exhaust air discharge feature 48. Exhaust air discharge feature 48 can advantageously be inserted into and attached to upper housing element 5. Exhaust air discharge feature 48 then forms expansion space 45 in the radially inner part together with upper housing element 5. In the radially outer part, upper housing element 5 and exhaust air discharge feature 48 define a preferably circumferential exhaust gap 49, which guides the suction air volume flow out of cleaning device 1 at the outlet. The separation between expansion space 45 and exhaust gap 49 can advantageously be achieved by separating wall 53, which is provided with passage holes 50. The discharge of the suction air volume flow through expansion space 45 and exhaust gap 49 improves the energy efficiency of vacuum generating means 6 and also has an advantageous impact on the noise or sound generation when the cleaning device is in operation.

Preferably, an illumination unit can be disposed in exhaust gap 49 and/or expansion space 45, the illumination unit having changeable light properties, preferably a changeable light color, and being linked and/or connected to setting means for setting the power of vacuum generating means 6. Preferably, the illumination unit can be a multi-color LED strip, which particularly preferably extends at least partially in the circumferential direction of air gap 49 or expansion space 45. Thus, the power of vacuum generating means 6 set by the user by means of the setting means can be optically outputted or indicated via upper housing element 5, in particular the open end of air gap 49.

As can be seen in FIG. 10, exhaust air discharge feature 48 is a single-piece, preferably even monolithic, component and comprises a handle 51 or a part of a handle. Handle 51 can preferably be composed of two parts and comprise two handle shells 52. One handle shell can advantageously be comprised or formed by exhaust air discharge feature 48. Second handle shell 52, which is illustrated in FIG. 9, for example, can be connected to handle shell 52 of exhaust air discharge feature 48 by a plug and/or snap-lock connection.

Figure 11:
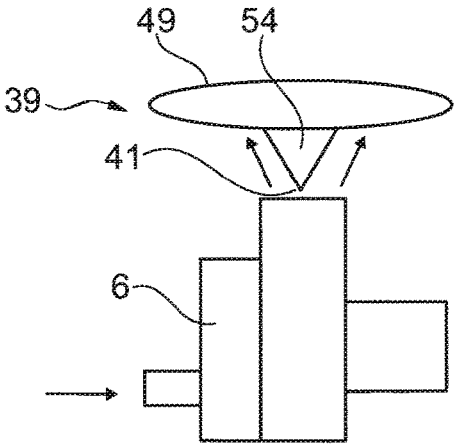
FIG. 11: is a schematic illustration of the suction air volume flow in an embodiment of the cleaning device according to the embodiments of FIGS. 7 to 10.

FIG. 11 once more schematically illustrates the routing of the suction air volume flow in the embodiments of FIGS. 7 to 10. At the entry of vacuum generating means 6, the suction air volume flow is aspirated with a relatively high pressure or vacuum, as marked by a corresponding arrow. At the outlet, in particular in the area of first portion 41 of air outlet 39, a conical flow distributor 54 is used to distribute the air flow at the motor outlet and thus reduce the wind shear noises and the ventilation noises. Then, a round and/or oval hood is used to disperse the wind pressure and thus reduce the wind speed and the wind noises. The hood can be formed by expansion space 45 and/or exhaust gap 49, for example.

REFERENCE SIGNS

1 cleaning device
2 air intake opening
3 immersion tube
4 liquid holding unit
5 upper housing element
6 vacuum generating means
7 first end of the immersion tube
8 second end of the immersion tube
9 deflecting portion
10 sinking portion
11 end face
12 bottom element
13 droplet separator
14 opening
15 exit area
16 pins
17 coarse filter
18 flowward area
19 fin
20 flow channel
21 first conduit cross section
22 second conduit cross section
23 side surface (first)
24 side surface (second)
25 closure means
26 lower housing element
27 filter unit
28 seat unit for a fabric filter
29 suction air path
30 fabric filter
31 air discharge opening
32 front
33 supply conduit
34 UVC light generation means
35 lid element of the immersion tube
36 cooling circuit supply air ventilation opening
37 vacuum generating means suction air volume flow discharge opening
38 vacuum generating means cooling circuit discharge opening
39 air outlet
40 inner housing element
41 first portion
42 mounts
43 damper element
44 bottom
45 expansion space
46 recess
47 recess
48 exhaust air discharge feature
49 exhaust gap
50 passage holes
51 handle
52 handle shell
53 separating wall
54 flow distributor
R_ein inflow direction
V vertical axis
H horizontal axis
α fixation angle
β deflection angle

The invention claimed is:

1. A cleaning device (1) for aspirating a suction air volume flow loaded with particles from an environment, the cleaning device comprising an air intake opening (2) having a first conduit cross section (21) and serving to aspirate the suction air volume flow loaded with the particles, aerosols, bacteria and/or viruses from the environment when the cleaning device (1) is in an active mode, a liquid holding unit (4) comprising an immersion tube (3) and serving to hold a liquid, the immersion tube (3) being connected to the air intake opening (2) in a suction-air-conducting manner at a first end (7) and being configured in such a manner that it is immersed in the held liquid, in such a manner at a second end (8) that the suction air volume flow loaded with the particles flows through the held liquid when the cleaning device (1) is in active mode so that the particles are retained, and vacuum generating means (6) for generating the suction air volume flow in active mode, wherein a second conduit cross section (22) of the immersion tube (3) for guiding the suction air volume flow is larger than the first conduit cross section (21) of the air intake opening (2) at least at the second end (8); wherein the cleaning device (1) comprises a droplet separator (13) disposed between the liquid holding unit (4) and the vacuum generating means (6) in a suction-air-conducting manner for retaining liquid droplets and other particles absorbed by the suction air volume flow; herein the droplet separator (13) comprises a flow ward area (18) formed by a plurality of spaced-apart profiled fins (19), a flow channel (20) having at least two deflection areas for the suction air volume flow being formed between each two adjacent fins (19), and/or the flow ward area (18) being oriented at a fixation angle (a) between 20° to 70°, relative to a horizontal plane (H1).

2. The device according to claim 1, wherein a ratio between the second conduit cross section (22) of the immersion tube (3) and the first conduit cross section (21) of the air intake opening (2) is at least 2.

3. The device according to claim 1, wherein the immersion tube (3) has at least one arched and/or angular deflecting portion (9) and a vertical sinking portion (10), the deflecting portion (9) being configured in such a manner that the suction air volume flow loaded with the particles is deflected relative to an inflow direction (R_ein) and swirled in active mode, and the sinking portion (10) being configured in such a manner that the suction air volume flow deflected in the deflecting portion (9) and swirled in active mode is decelerated relative to a mean inflow velocity by a widened portion of the second conduit cross section.

4. The device according to claim 3, wherein the deflecting portion (9) is configured in such a manner that the suction air volume flow loaded with the particles is deflected by a deflection angle (β) greater than 60° relative to the inflow direction (R_ein) in active mode.

5. The device according to claim 3, wherein the immersion tube (3) is disposed in the liquid holding unit (4) in such a manner that the sinking portion (10) extends along a vertical axis (V) in such a manner that, in active mode, the suction air volume flow sinks vertically and thus flows into the liquid essentially perpendicular to the liquid surface formed by the held liquid when the cleaning device (1) is in standby mode.

6. The device according to claim 1, wherein the immersion tube (3) has an exit area (15) with a plurality of openings (14) for forming a coarse filter (17), in the area of the sinking portion (10), the openings (14) being formed by a plurality of rod-shaped pins (16) in the manner of slots and/or gaps, the pins being disposed and/or oriented parallel to each other.

7. The device according to claim 1, wherein at the second end (8), the immersion tube (3) has an end face (11) which is connected to a bottom element (12) of the liquid holding unit (4) in such a manner that the suction air volume flow flows out of the immersion tube (3) exclusively through the openings (14) in active mode.

8. The device according to claim 1, wherein the droplet separator (13) is static and/or immobile and composed of non-rotating elements.

9. The device according to claim 1, wherein the cleaning device (1) comprises a filter unit (27) for filtering out fine particles carried by the suction air volume flow, the filter unit (27) being disposed in a suction-air-conducting manner between the droplet separator (13) and the vacuum generating means (6) in a suction air path (29) formed in the cleaning device (1) by the suction air volume flow in active mode.

10. The device according to claim 9, wherein the filter unit (27) comprises a seat unit (28) for an exchangeable fabric filter (30), the seat unit (28) being configured in such a manner that the suction air volume flow flows through the fabric filter (30) in active mode so that the fine particles are retained.

11. The device according to claim 1, wherein the cleaning device (1) comprises UV- and/or UVC-light generation means (34) disposed in the cleaning device (1) in such a manner that the suction air path (28) is partially illuminated in such a manner, along a passage of the suction air path (29), that the suction air volume flow generated in active mode is fully illuminated in order to kill carried viruses or germs.

12. The device according to claim 2, wherein the ratio is at least 3.

13. The device according to claim 2, wherein the ratio is at least 3.5.

14. The device according to claim 4, wherein the deflection angle (β) is greater than 70°.

15. The device according to claim 4, wherein the deflection angle (β) is greater than 80°.

16. The device according to claim 4, wherein the deflection angle (β) is about 90°.

17. The device according to claim 1, wherein the fixation angle (α) is between 30° to 60°.

18. The device according to claim 1, wherein the fixation angle (α) is between 40° to 50°.

* * * * *